US008359668B2

(12) United States Patent
Elliott

(10) Patent No.: US 8,359,668 B2
(45) Date of Patent: Jan. 29, 2013

(54) HAT TRACTION SWEATBAND

(76) Inventor: Vernal George Elliott, Vernon (CA)

( * ) Notice: Subject to any disclaimer, the term of this patent is extended or adjusted under 35 U.S.C. 154(b) by 429 days.

(21) Appl. No.: 12/656,641

(22) Filed: Feb. 5, 2010

(65) Prior Publication Data

US 2011/0191938 A1 Aug. 11, 2011

(51) Int. Cl.
*A42C 5/02* (2006.01)

(52) U.S. Cl. ..... 2/181

(58) Field of Classification Search ..... 2/181, 183
See application file for complete search history.

(56) References Cited

U.S. PATENT DOCUMENTS

| | | | | |
|---|---|---|---|---|
| 174,998 | A | 3/1876 | Abbott | |
| 297,715 | A | 4/1884 | Protheroe | |
| 1,170,052 | A | 2/1916 | Diener et al. | |
| 1,186,316 | A | 6/1916 | Holmes | |
| 1,961,739 | A | 6/1934 | Cavanagh | |
| 1,997,017 | A | 4/1935 | Roeloffzen | |
| 2,445,209 | A | 7/1948 | Clark | |
| 2,585,896 | A * | 2/1952 | Hoffman | 2/184 |
| 2,698,434 | A | 1/1955 | Davia | |
| 2,814,046 | A | 11/1957 | Lev | |
| 3,041,621 | A | 7/1962 | Brockway | |
| 3,089,146 | A | 5/1963 | Sterne | |
| 3,168,748 | A | 2/1965 | Limberg | |
| 3,203,003 | A | 8/1965 | Plastino | |
| 3,684,055 | A | 8/1972 | Militello | |
| 4,434,514 | A | 3/1984 | Sundahl | |
| 4,951,320 | A | 8/1990 | Yoon | |
| 5,058,210 | A | 10/1991 | Tivis | |
| 5,101,516 | A | 4/1992 | Scarnato | |
| 5,365,607 | A | 11/1994 | Benevento | |
| 5,613,248 | A | 3/1997 | Young | |
| 5,787,507 | A | 8/1998 | Sullivan | |
| 6,966,074 | B2 * | 11/2005 | Huh | 2/414 |
| 7,032,366 | B1 | 4/2006 | Williams | |
| 2008/0034473 | A1 | 2/2008 | Wong | |

* cited by examiner

*Primary Examiner* — Katherine Moran
(74) *Attorney, Agent, or Firm* — Antony C. Edwards

(57) ABSTRACT

An improved traction sweatband includes a flexible collar for fitting onto the head of a wearer. The front of the collar has at least one aperture formed therein. The aperture or apertures each have a circumferential edge extending completely around the aperture. A flexible resilient sheet or sheets are mounted to the back surface of the collar so as to cover each aperture in the front of the collar. Each resilient sheet is mounted around the circumferential edge of its corresponding aperture. The mounting of the sheet to the circumferential edge is adapted so as to draw the sheet against the circumferential edge and so as to urge the sheet into the aperture to thereby bow the sheet into and across the aperture.

12 Claims, 8 Drawing Sheets

HAT TRACTION SWEATBAND

FIELD OF THE INVENTION

This invention relates to the field of sweatbands for hats and in particular to sweatbands having inserts to improve the frictional adherence of the sweatband to the head of a wearer and for improving both the frictional traction and the comfort of the wearing of the sweatband when mounted in a hat.

BACKGROUND OF THE INVENTION

Many sports require the wearing of a helmet, hat, cap or the like. In many sports the head wear is secured onto the competitor's head by the use of a chin strap. However in some sports, for example in western horsemanship including reining, cutting, roping and barrel racing, competitors conventionally wear so-called cowboy hats without the use of a snug chin strap which would otherwise detract from the look. Thus those competitor's find that at high speed, the cowboy hats are lifted from the competitor's heads by the apparent wind due to their forward movement catching underneath the forward brim of the hat and thereby peeling the hat backwards. It is consequently an object of the present invention to provide a sweatband for use in cowboy hats and other hat styles which increases both the frictional traction holding the hat on a wearer's head and the comfort of the hat.

The prior art of which applicant is aware is replete with modified sweatband designs, the following referenced being a selection from such prior art:

U.S. Pat. No. 1,186,316 which issued Jun. 6, 1916 for a Hat to Holmes discloses providing the exposed face of a sweatband with means preferably in the form of rubber surfaces adapted to frictionally engage the head of the wearer in such a manner as to firmly hold the hat upon the head, wherein, in one embodiment, the exposed surface of the sweatband is depressed at intervals to form slight projections extending above its inner surface into engagement with the hat. Thin sheet rubber is secured to the exposed surface of the sweatband in registry with the depressions. When the hat is placed firmly upon the head, the hat exerts a pressure on the projections and thus causes the sections or pieces to be brought into firm and frictional engagement with the head of the wearer.

U.S. Pat. No. 2,698,434, which Jan. 4, 1955 to Davia for a Baseball Cap, discloses a sweatband made of resilient foam rubber by molding the sweatband to have a series of outward projections which are spaced apart and distributed entirely around the inside of the band so as to cause the cap to cling to the head, the sponge rubber sweatband being quite thick so as to absorb the shock of a blow against the outside of the cap.

U.S. Pat. No. 3,168,748 which issued Feb. 9, 1965 to Limberg for a Hat with Power Cooling teaches a sweatband which is channelled to receive a sponge which extends circumferentially of the hat to any desired extent. The sweatband is provided with an aperture which may be spanned by loosely woven net or fabric to support the sponge slightly clear of the wearer's forehead.

U.S. Pat. No. 5,101,516 which issued Apr. 7, 1992 to Scarnato for a System for Ventilating Brow Band Area of a Cap/Sun Visor discloses a sweatband having spaced apart, resiliently, porous, absorbent members removably engaged to an area of the sweatband which would normally engage the forehead of the wearer to space that area of the sweatband away from the forehead.

U.S. Pat. No. 5,613,248 which issued Mar. 25, 1997, to Young for a Sweatband for a Hat, teaches a sweatband that may be easily inserted and removed from a hat wherein the sweatband includes a flexible retaining strip attached to the inside surface of the hat, wherein one end of the strip is removably attached, a tubular sweatband being mountable around the retaining strip and thereby retained in the hat when the strip is fastened to the hat.

SUMMARY OF THE INVENTION

In summary the improved traction or anti-slip sweatband according to one aspect of the present invention may be characterized as including a flexible collar for fitting onto the head of a wearer and for forming a substantially oval opening for the head of the wearer when the collar is mounted into the interior of a hat, and wherein the collar has a front, a rear, and a circumference. An exposed surface of the collar extends around the circumference on the interior of the collar. A back surface, opposite to the exposed surface, extends around the circumference on the exterior of the collar, whereby when the collar is mounted in the hat and the hat worn on the head of the wearer, the exposed surface of the collar is in contact with the head of the wearer including the forehead of the wearer.

The front of the collar has at least one aperture formed therein. The aperture or apertures each have a circumferential edge extending completely around the aperture. The aperture or apertures are positioned to extend between, and cover to at least, laterally spaced apart sides of a radial sector covering substantially a frontal one third of the circumference, the frontal one third corresponding to the front of the collar.

A flexible resilient sheet or sheets are mounted to the back surface of the collar so as to cover each aperture in the front of the collar. Each resilient sheet is mounted around the circumferential edge of its corresponding aperture. The mounting of the sheet to the circumferential edge is adapted so as to draw the sheet against the circumferential edge and so as to urge the sheet into the aperture to thereby bow the sheet into and across the aperture to extend an interior surface of the sheet, corresponding to the exposed surface of the collar, in a convex curvature which is flush with the circumferential edge and elevated from the circumferential edge so as to elevate the sheet into contact with the wearer's forehead.

In one embodiment the resilient sheet may be made of neoprene or formed from other cushioning material, for example having a criss-cross or waffle mesh pattern. The sheet may be mounted to the edge of the aperture or apertures by stitching, for example cross-stitching. The edge of the aperture is beveled along at least the exposed surface of the collar but this is not intended to be limiting as the beveling could be of both sides of the circumferential edge also. The aperture may be a single aperture which may extend substantially entirely across the radial sector of the front of the collar. Where the apertures include at least a pair of apertures, apertures may be spaced apart by substantially the entire radial sector, whereby the apertures are positioned to overlay the prominent sides of the forehead of the wearer when the sweatband is worn by the wearer.

In a competition embodiment of the sweatband, the sheet may be adapted to exhibit a tackiness on the interior surface of the sheet by the choice of material such as neoprene, silicone rubber, or other such polymer products which would provide increased friction when in contact with the forehead as compared to leather or vinyl sweatbands. The sheet may be adapted to exhibit increased friction or tackiness upon dampening of the interior surface of the sheet by perspiration moisture.

Advantageously the interior surface of the sheet is uneven for example bumpy or corrugated so as to apply an increased point pressure where the bumps or elevations of the sheet contact against the forehead of a wearer upon wearing of the sweatband by the wearer.

The stitching of the sheet to the circumferential edge of each aperture may include extending the stitching onto the interior surface of the sheet which is exposed through the aperture or apertures and also extending the stitching onto the collar around the circumferential edge of the aperture. The stitching draws the sheet against the circumferential edge and urges the sheet to bow from the plane of the aperture. The sheet is thereby bowed into and across the aperture to form the convex curvature of the interior surface of the sheet in the aperture.

The circumferential edge of each aperture may be beveled on at least the exposed side of the circumferential edge to thereby form a smooth transitional surface from the circumferential edge onto the interior surface of the sheet in the aperture.

DETAILED DESCRIPTION OF EMBODIMENTS OF THE INVENTION

Figure 1:
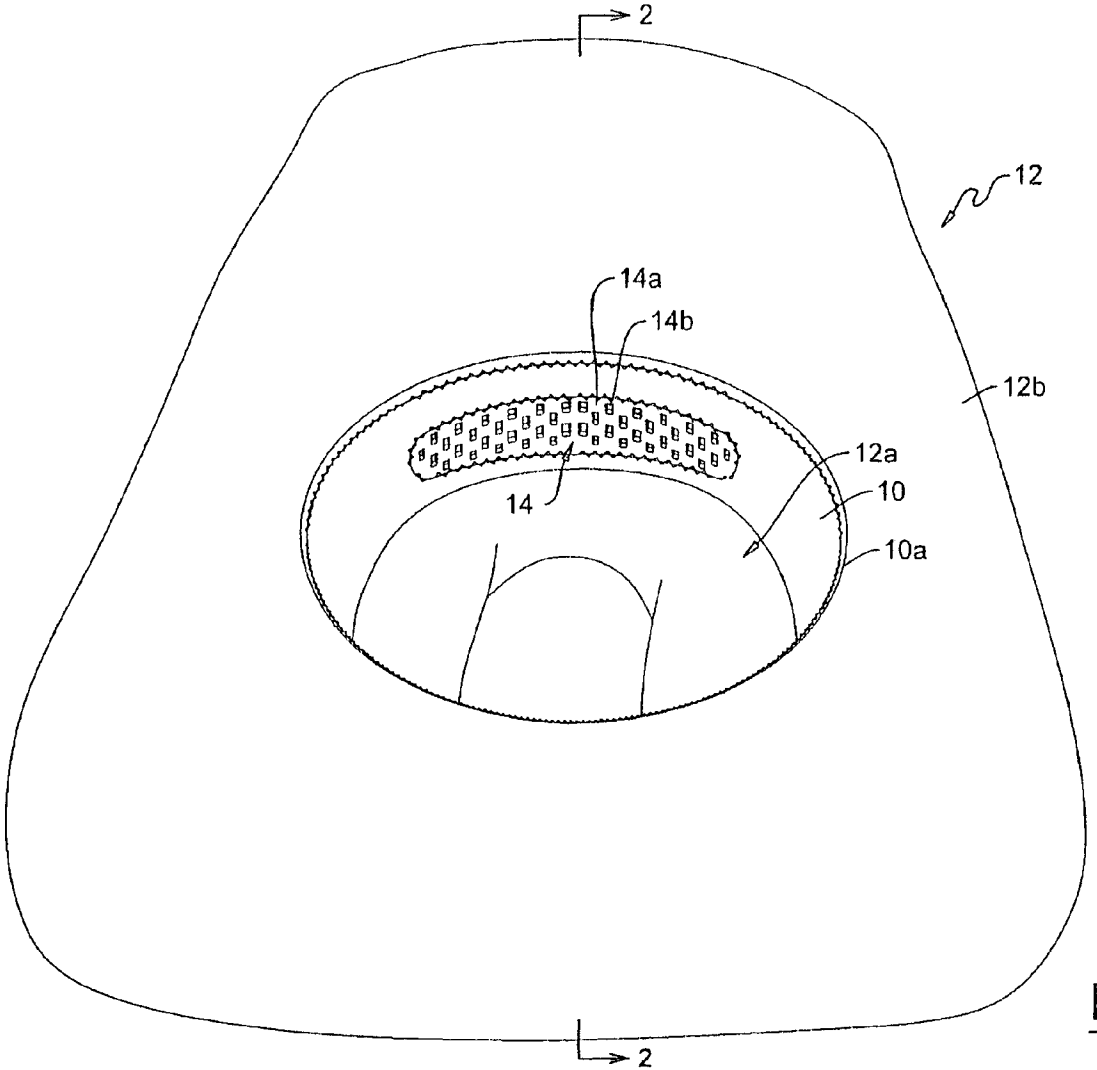
FIG. 1 is, in rear underside perspective view, a cowboy hat in which a sweatband according to one embodiment of the present invention is mounted.
Figure 2:
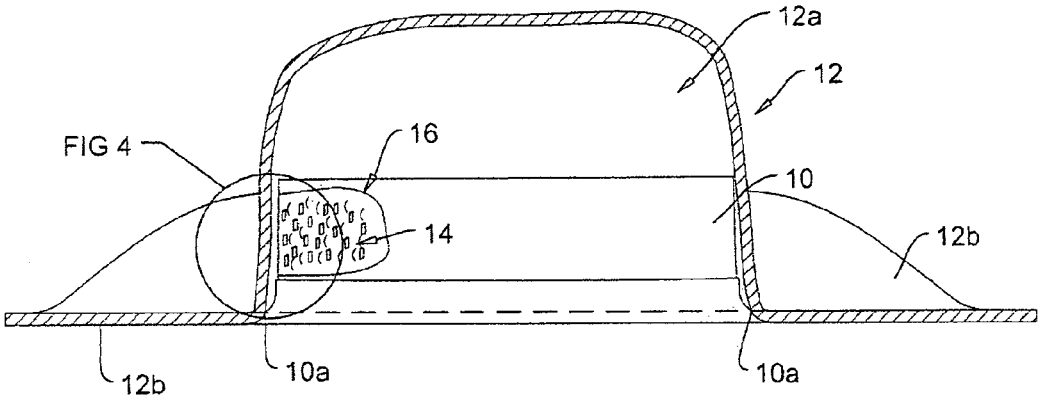
FIG. 2 is a cross-sectional view along line 2-2 in FIG. 1.
Figure 3:
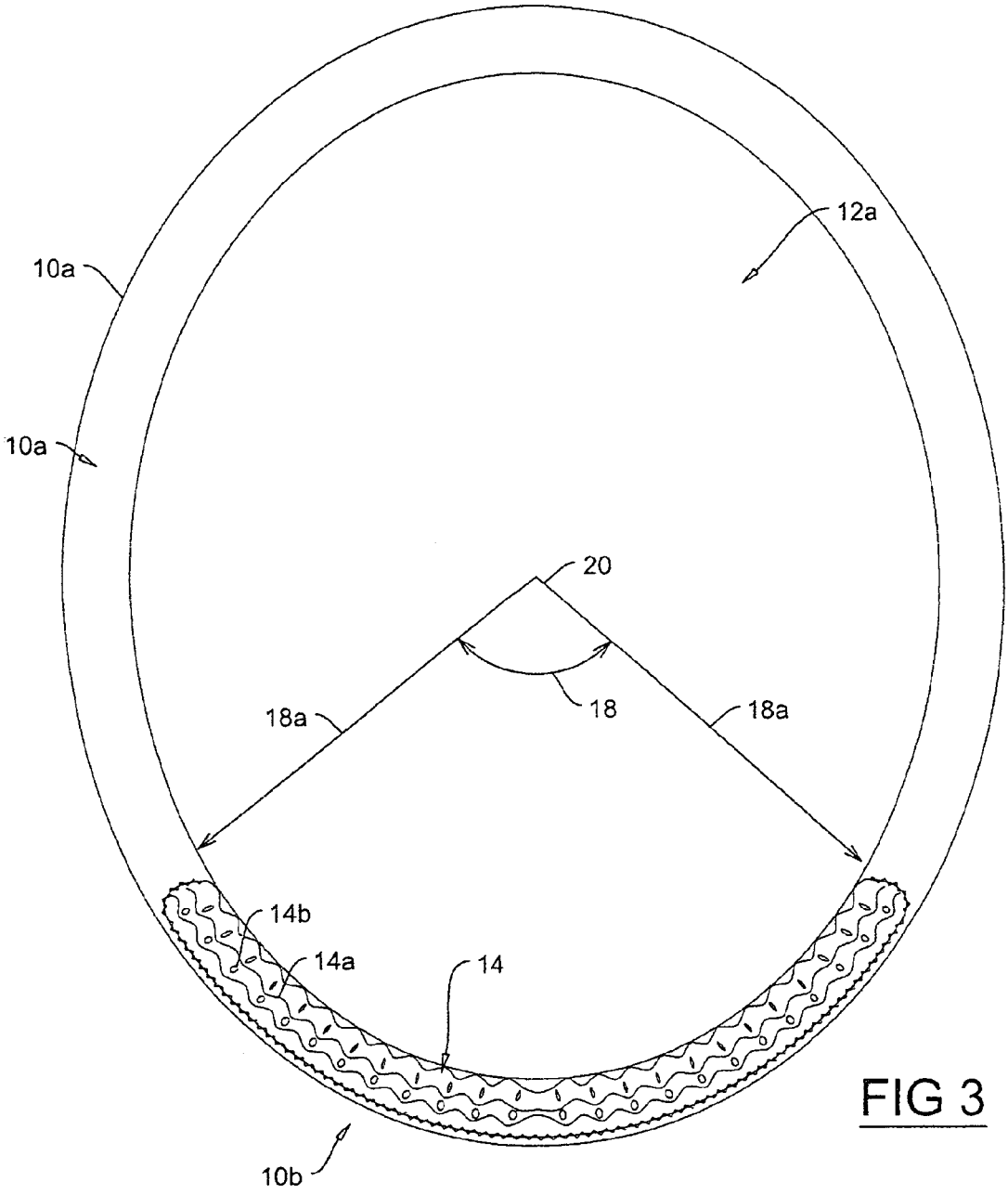
FIG. 3 is a bottom view of the hat sweatband of FIG. 1 removed from the hat.

As seen in FIGS. 1-3 a sweatband 10 is mounted by its lower most circumferential rim 10*a*, normally by stitching, to the circumferential intersection of the interior cavity 12*a* with brim 12*b* of hat 12. In one embodiment, and without intending to be limiting, hat 12 is a so-called cowboy hat as depicted. Sweatband 10 is sized so as to comfortably fit over wearer's head and so as to typically form a snug slip-down fit of the sweatband onto the head of the wearer between the crown and ears and so as to cover a substantially laterally extending band across the forehead of the wearer.

When a prior art sweatband is only sufficiently snug so as to provide a comfortable fit for the wearer, the brim of the hat will often be caught by the wind up under the brim causing the hat to peel off from the top of the head of the wearer. If conventional sweatbands are sized so as to be very tight fitting onto the head of the wearer so as to prevent the hat being inadvertently removed by the wind, this tends to make the hat somewhat uncomfortable to wear for prolonged periods of time. Consequently, the sweatband according to the present invention provides a resilient pad 14 exposed through an aperture 16 formed in the frontal section 10*b* of sweatband 10 so as to traverse along the sweatband a radial sector 18 extending between the laterally spaced apart sides 18*a* of radially sector 18, where radially sector 18 is centered on substantially the center point 20 of the somewhat oval shape formed by sweatband 10 when mounted in hat 12 so as to accommodate the typical shape of the crown and forehead of the head of a wearer.

Figure 3A:
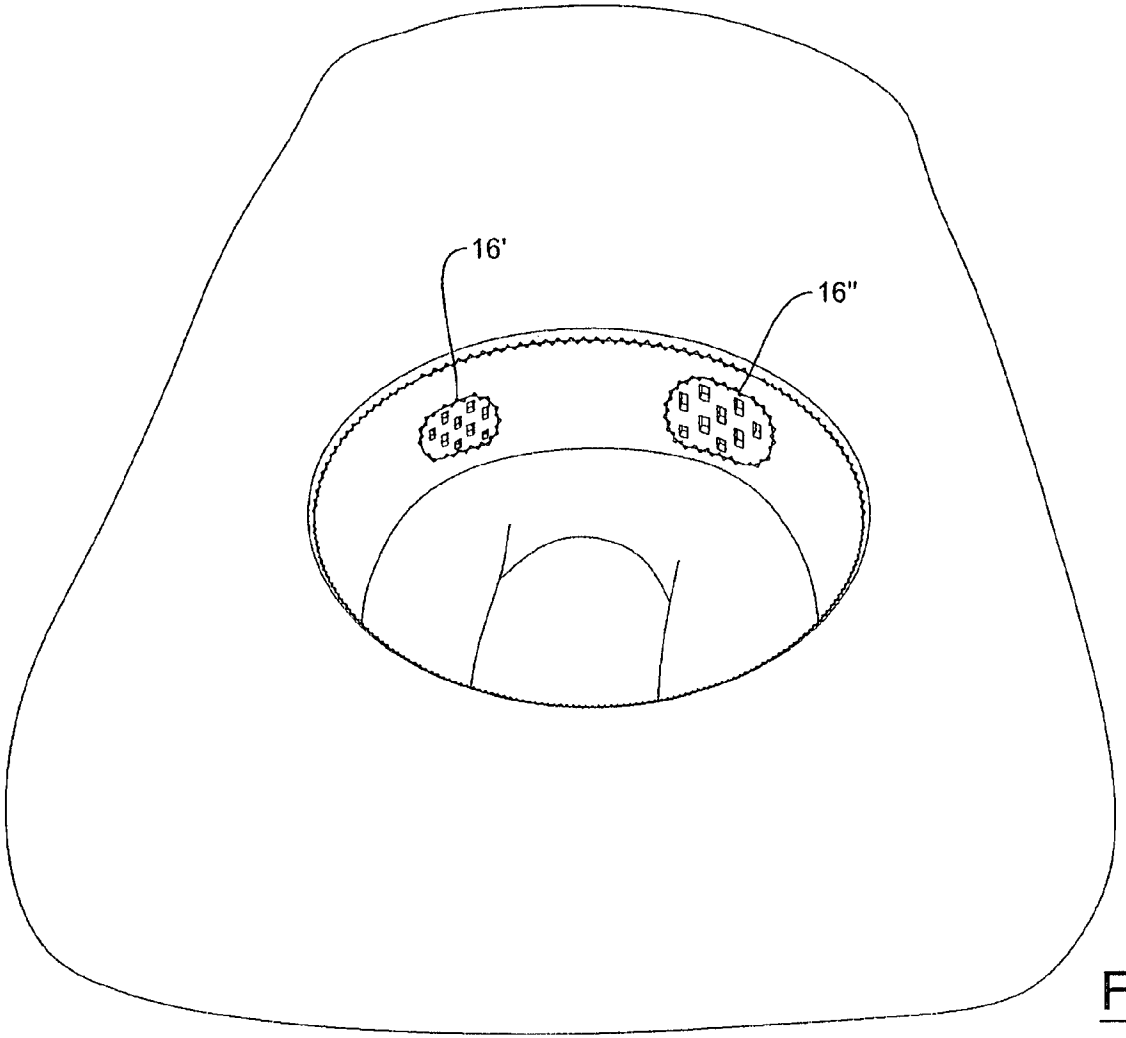
FIG. 3*a* is the view of FIG. 1 illustrating two alternative embodiments of the sweatband pad according to alternative embodiments with the present invention.

In one embodiment, for example in the embodiment illustrated in FIG. 3, aperture 16 is a single laterally extending elongate aperture sized so as to extend completely across the forehead of the wearer and so as to extend over and at least slightly around onto the temples of the wearer so that the more prominent corners of the forehead of the wearer engage against pad 14 when hat 12 is worn. Thus in the alternative embodiment of FIG. 3*a*, illustrated by way of example and not intending to be limiting, instead of sweatband 10 having a single elongate aperture 16, a pair of apertures for example a pair of smaller apertures 16' or a pair of larger apertures 16" are formed by cut-outs in headband 10 and positioned so as to advantageously cover at least the prominent portions of the sides of the wearers forehead immediately ahead of the temples of the wearer. The placement of pad 14 in embodiments according to the present invention thus provides for a maximum frictional engagement or traction of pad 14 against the typically most prominent features of a wearer's forehead, and in particular the side "corners" of a wearer's forehead so as to optimize the balance between anti-slip frictional engagement of pad 14 against the forehead and maintaining comfort for the wearer when wearing hat 12 for extended periods of time.

In order to optimize the traction, in other words, the anti-slip friction of pad 14 against the forehead of a wearer on the one hand, and the comfort of wearing the hat for the wearer on the other hand, in a preferred embodiment, pad 14 is a cushioned resilient elastomeric material for example neoprene, and in the illustrated embodiment a waffle-weave neoprene. Applicant has used of a single layer of that waffle-weave neoprene which is sufficiently soft, for example approximately 25 shore∞durometer scale hardness of 45 to 55 and having a thickness of approximately 5 mm, for example that sold for use as the top and bottom outer layer foam pad material or scrim component of equine saddle pads by Reinsman Equestrian Products of Cleveland, Tenn., U.S.A., and such as disclosed in U.S. Pat. No. 7,032,366, (the "Reinsman patent"). These have been found to work quite well due to its softness and tackiness. The Reinsman patent is incorporated herein in its entirety. The illustrations herein are intended to represent the use of such waffle-weave neoprene. Thus as illustrated, the waffle-weave neoprene has an undulating or corrugated surface when uncompressed, with soft raised bumps 14*a* connected by corresponding soft ridges and interleaved between arrays of small ventilation holes 14*b*.

In the embodiment of FIGS. 1-4 and 4*a* pad 14 consists of an elongate strip of waffle-weave neoprene such as described above which is sized for mounting behind, that is, on the non-exposed surface of sweatband 10 so as to entirely cover over aperture 16 and to extend from aperture 16, and in particular from the circumferential edge 16*a* of aperture 16, so as to overlap behind sweatband 10 to allow for the attachment of the outer edge of pad 14 to the rear of the sweatband. This then places pad 14 between sweatband 10 and the inside of hat 12 once the collar formed by sweatband 10 is mounted into hat 12 along lower rim 10*a*. Thus with pad 14 positioned behind aperture 16, so as to overlap the edges 14*c* of pad 14 behind circumferential edge 16*a*, edges 14*c* may be secured for example by means of the diagrammatic representation of cross-stitching 22 illustrated, although is intended to be within the scope of the present invention to include other means of securing edges 14*c* to circumferential edge 16*a* in order to accomplish the improvement herein next described. Thus for example, other forms of stitching would work as would be known to one skilled in the art as would adhesives if correctly applied as by one skilled in the art.

Figure 4:
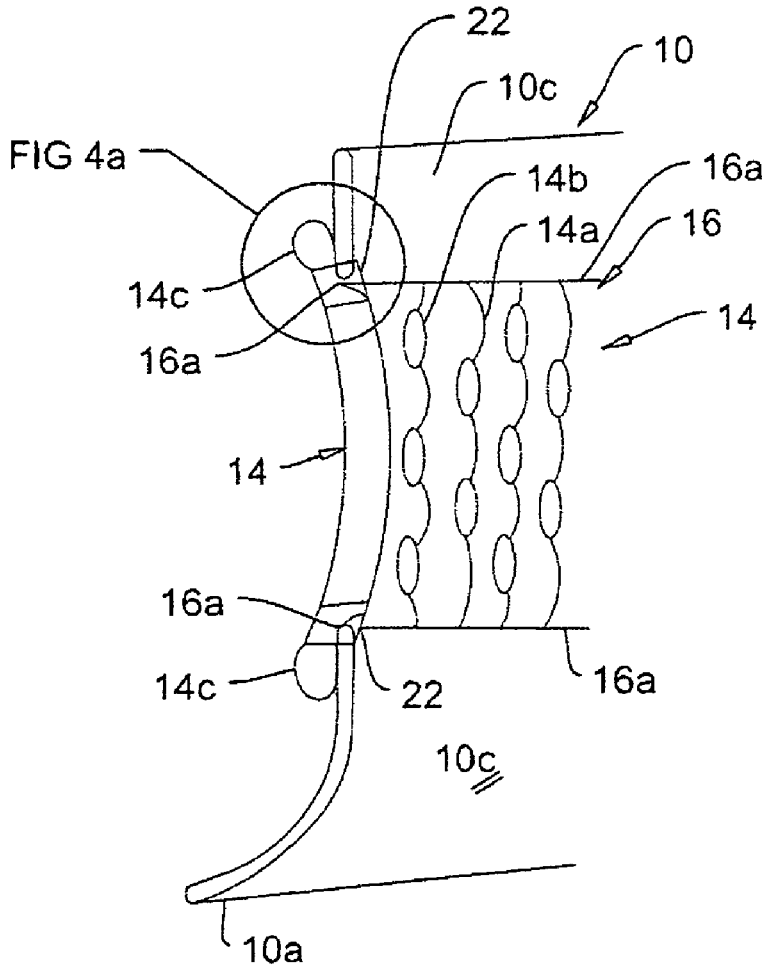
FIG. 4 is an enlarged view of a portion of FIG. 2.
Figure 4A:
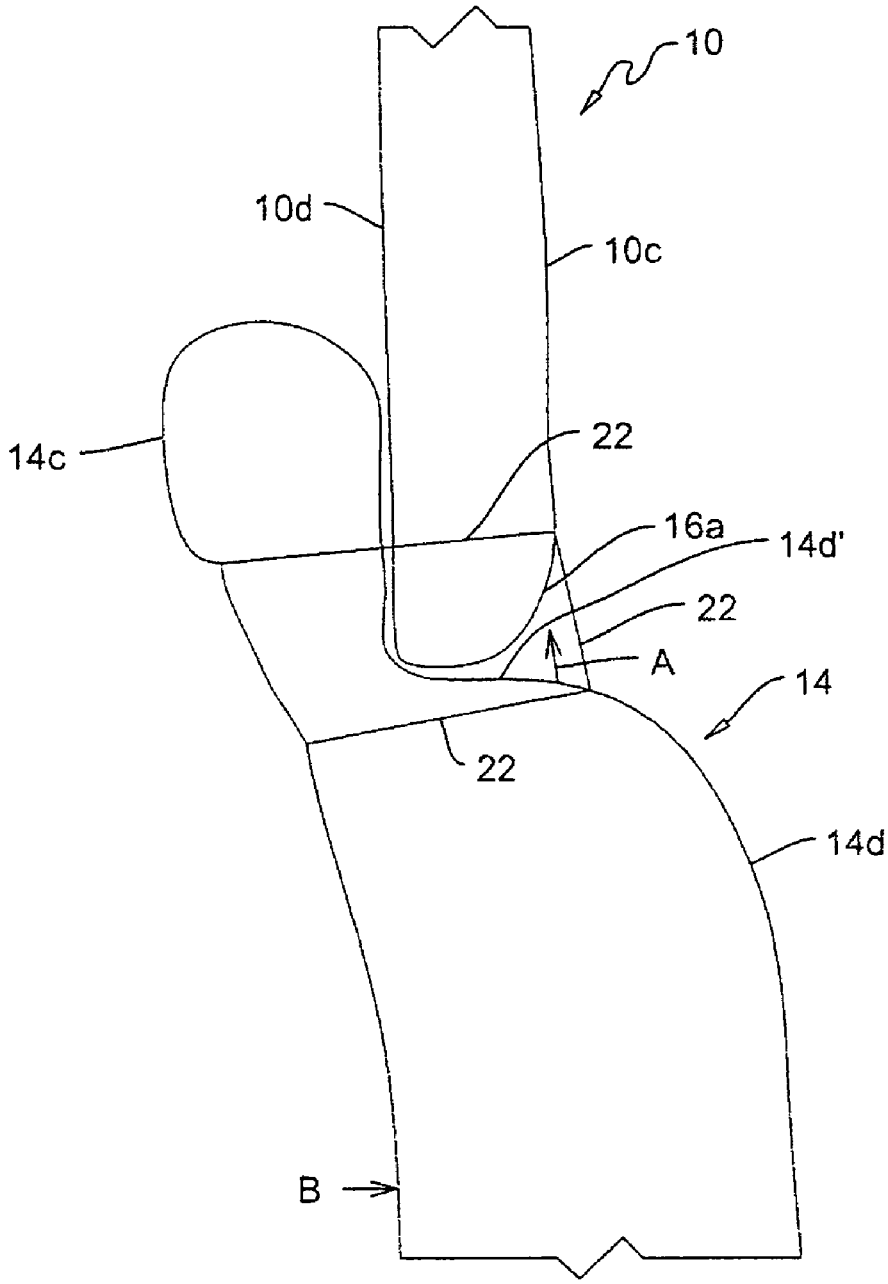
FIG. 4*a* is an enlarged view of a portion of FIG. 4.
Figure 5:
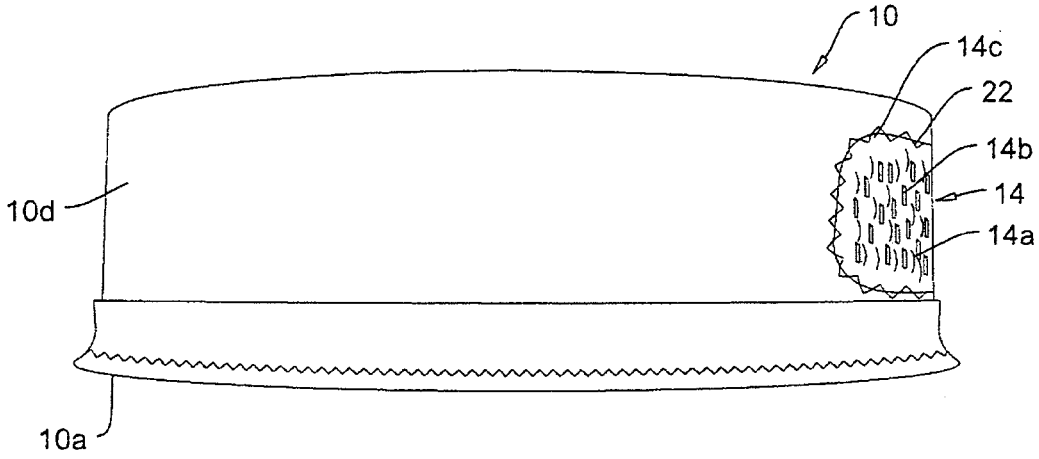
FIG. 5 is, in side elevation view, the sweatband of FIG. 2 removed from the hat.
Figure 6:
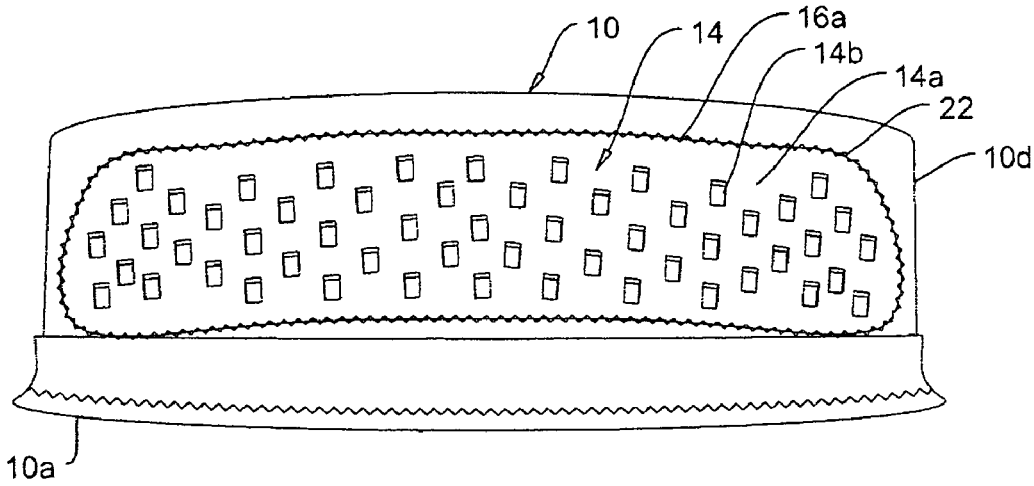
FIG. 6 is, in front elevation view, the sweatband of FIG. 5.

It has also be found further advantageous to bevel circumferential edge 16*a*, for example to produce a half round as illustrated or for example a half bull-nose or otherwise bevelled or sloped finish so that the exposed surface 10*c* (opposite rear surface 10*d*) of the flexible preferably leather collar of sweatband 10 is bevelled to remove what would otherwise be a sharp corner formed at edge 16*a* on the exposed surface side of the circumferential edge of aperture 16. This removes a sharp edge where it otherwise might press into the skin on the forehead of a wearer. As seen in FIG. 4*a*, stitching such as cross-stitching 22 pulls edges 14*c* against the rear surface 10*d* causing the interior surface 14*d* of pad 14 to wrap around edge 16*a*. Stitching 22 draws interface surface 14*d*' of interior surface 14*d* in direction A towards the bevelled edge of edge 16*a* thereby resulting in a relatively conformally smooth transition between edge 16*a* and interior surface 14*d*. This is a smooth transition from the exposed surface 10*c*, and in particular from edge 16*a* onto the bulge formed at interface surface 14*d*' of interior surface 14*d*, where the resilient material of pad 14 expands where is adjacent to and constrained by stitching 22. Applicant has observed that the result of stitching 22 drawing edges 14*c* and interface surface 14*d*' into, so as to wrap around, circumferential edge 16*a* not only draws interface 14*d*' in direction A but also urges pad 14 in direction B, the result being that the exposed surface of pad 14 exposed within aperture 16, that is interior surface 14*d*, forms a convex shape relative to the plane containing exposed surface 10*c* in the cross sectional view of FIG. 4*a*, the convex shape elevates interior surface 14*d* in a shape approximating a convex band so as to bring the bumps 14*a* of pad 14 into an elevation which is raised, or prominent to, or proud of exposed surface 10*c* of sweatband 10.

Thus when a wearer puts on hat 12, advantageously by first engaging pad 14 with the wearer's forehead and then seating the rear of sweatband 10 down onto the rear of the crown of the wearer's head, pad 14 including bumps 14*a* are softly and resiliently compressed against the wearer's forehead into frictional engagement there against. Applicant has found that neoprene such as described above, although this not intended to be limiting, exhibits a comfortable cushioning fit of the sweat band onto the wearer's head while at the same time increasing the friction between the wearer's forehead and the sweatband so as to retain hat 12 on the wearer's head in an improved fashion.

Notwithstanding that waffle-weave neoprene is illustrated and discussed above as a preferred embodiment it is intended that other resilient materials used for pad 14 be included within the scope of the present invention. For example, other resilient materials would also work for example sheets of other elastomers, silicone rubber, or like materials including those having an uneven or corrugated surface or other polymer and/or foamed materials which exhibit a soft resilient cushioning and which will increase the friction as compared to for example a conventional smoothly finished leather sweatband engaged against the wearer's forehead. The desired material of pad 14 for example may include those materials which exude a certain level of tackiness including not only neoprene but also urethane, silicone, and open and closed cell foams which are also soft, resilient and may be somewhat tacky or sticky. It may be possible that high level competitors, for example, in the sport of western reining cutting, roping, and barrel racing, would desire an increased level of adhesion between pad 14 and the competitors forehead at the cost of some comfort.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An anti-slip sweatband for a hat, the sweatband comprising:

a flexible collar for fitting onto the head of a wearer and for forming a substantially oval opening for the head of the wearer when said collar is mounted into the interior of a hat, said collar having a height, a front, a rear opposite to said front, an interior and an opposite exterior, and a circumference, wherein an exposed surface of said collar extends around said circumference on said interior of said collar, and a back surface, opposite to said exposed surface, extends around said circumference on said exterior of said collar, whereby when said collar is mounted in the hat and the hat worn on the head of the wearer, said exposed surface of said collar is in contact with the head of the wearer including the forehead of the wearer, said front having at least one aperture formed therein, wherein said at least one aperture has a circumferential edge extending completely therearound and wherein said at least one aperture is positioned to extend between, and cover at least, laterally spaced apart sides of a radial sector covering substantially a frontal one third of said circumference, said frontal one third corresponding to said front of said collar, a flexible resilient sheet mounted to said back surface of said collar so as to cover said aperture in said front of said sweatband, wherein said resilient sheet is mounted around said circumferential edge of said aperture so as to draw said sheet against said circumferential edge and so as to urge said sheet into said aperture and wherein said sheet is thereby bowed into and across said aperture to extend an interior surface of said sheet, corresponding to said interior surface of said collar, in a convex curvature which is flush with said circumferential edge around said circumferential edge and elevated from said circumferential edge so as to contact the forehead of the wearer in a band extending across said aperture, wherein said sheet is mounted to said circumferential edge of said at least one aperture by stitching around said circumferential edge, wherein said stitching includes extending said stitching onto said interior surface of said sheet exposed through said at least one aperture and onto said collar around said circumferential edge of said at least one aperture, whereby said stitching draws said sheet against said circumferential edge and urges said sheet into said aperture wherein said sheet is thereby bowed into and across said aperture to form said convex curvature of said interior surface of said sheet in said at least one aperture.

2. The sweatband of claim 1 wherein said circumferential edge is beveled on at least said exposed side of said circumferential edge to thereby form a smooth transitional surface from said circumferential edge onto said interior surface of said sheet in said at least one aperture.

3. The sweatband of claim 2 wherein said sheet is adapted to exhibit a tackiness on said interior surface of said sheet.

4. The sweatband of claim 3 wherein said sheet is adapted to exhibit increased tackiness upon dampening of said interior surface of said sheet by perspiration moisture.

5. The sweatband of claim 4 wherein said interior surface of said sheet is uneven so as to apply an increased point pressure against the forehead of a wearer upon wearing of said sweatband by the wearer.

6. The sweatband of claim 5 wherein said sheet is made of a cushioning material.

7. The sweatband of claim 6 wherein said sheet is made of a foamed material.

8. The sweatband of claim 7 wherein said sheet is made of neoprene.

9. The sweatband of claim 8 wherein said sheet is mounted to said circumferential edge of said at least one aperture by stitching around said circumferential edge.

10. The sweatband of claim 2 wherein said stitching includes cross-stitching.

11. The sweatband of claim 10 wherein the forehead of the wearer has prominent sides and wherein said at least one aperture includes at least a pair of apertures spaced apart by substantially said radial sector, whereby said apertures overlay the prominent sides of the forehead of the wearer when the sweatband is worn by the wearer.

12. The sweatband of claim 10 wherein said at least one aperture is a single aperture which extends substantially entirely across said radial sector of said front.

* * * * *